US011538379B2

(12) United States Patent
Liu et al.

(10) Patent No.: US 11,538,379 B2
(45) Date of Patent: Dec. 27, 2022

(54) FOLDABLE DISPLAY PANEL AND DRIVING METHOD THEREOF, DISPLAY DEVICE AND ELECTRONIC APPARATUS

(71) Applicants: Chengdu BOE Optoelectronics Technology Co., Ltd., Sichuan (CN); BOE TECHNOLOGY GROUP CO., LTD., Beijing (CN)

(72) Inventors: Ke Liu, Beijing (CN); Ling Shi, Beijing (CN); Yanqiang Wang, Beijing (CN); Yunhao Wang, Beijing (CN); Xiaoqi Ding, Beijing (CN)

(73) Assignees: CHENGDU BOE OPTOELECTRONICS TECHNOLOGY CO, LTD., Sichuan (CN); BOE TECHNOLOGY GROUP CO, LTD., Beijing (CN)

( * ) Notice: Subject to any disclaimer, the term of this patent is extended or adjusted under 35 U.S.C. 154(b) by 0 days.

(21) Appl. No.: 17/537,196

(22) Filed: Nov. 29, 2021

(65) Prior Publication Data

US 2022/0319369 A1 Oct. 6, 2022

(30) Foreign Application Priority Data

Mar. 30, 2021 (CN) ..... 202110343339.1

(51) Int. Cl.
*G09G 3/00* (2006.01)
*G09G 3/3233* (2016.01)
(Continued)

(52) U.S. Cl.
CPC ..... *G09G 3/035* (2020.08); *G09G 3/3233* (2013.01); *G09G 3/3266* (2013.01);
(Continued)

(58) Field of Classification Search
None
See application file for complete search history.

(56) References Cited

U.S. PATENT DOCUMENTS

2015/0316976 A1* 11/2015 Toyotaka ..... G06F 1/1643 361/679.27
2018/0047316 A1* 2/2018 Zhou ..... G09G 3/2092
2020/0357362 A1 11/2020 Shin et al.

FOREIGN PATENT DOCUMENTS

CN 109243309 A 1/2019
CN 109637417 A 4/2019
(Continued)

OTHER PUBLICATIONS

Office Action received for Chinese Patent Application No. 202110343339 1, dated Nov. 25, 2021, 25 pages (11 pages of English Translation and 14 pages of Office Action).

*Primary Examiner* — Christopher J Kohlman
(74) *Attorney, Agent, or Firm* — Womble Bond Dickinson (US) LLP

(57) ABSTRACT

The present disclosure provides a foldable display panel that includes a plurality of display areas, each of which includes a pixel array. The foldable display panel further includes a plurality of data transmission control signal lines and a plurality of data transmission control circuits corresponding to the plurality of display areas. Based on the plurality of data transmission control signal lines and the plurality of data transmission control circuits, the foldable display panel can provide data signals to the display area(s) for display in a time-division multiplexing manner. The present disclosure also relates to a driving method for driving the foldable display panel, a display device including the foldable display panel, and an electronic apparatus including the display device.

18 Claims, 7 Drawing Sheets

(51) Int. Cl.
*G09G 3/3275* (2016.01)
*G09G 3/3266* (2016.01)

(52) U.S. Cl.
CPC ... *G09G 3/3275* (2013.01); *G09G 2300/0408* (2013.01); *G09G 2300/0426* (2013.01); *G09G 2310/0202* (2013.01); *G09G 2310/0243* (2013.01); *G09G 2310/08* (2013.01); *G09G 2320/043* (2013.01); *G09G 2330/021* (2013.01); *G09G 2370/00* (2013.01)

(56) References Cited

FOREIGN PATENT DOCUMENTS

| | | | |
|---|---|---|---|
| CN | 110136634 | A | 8/2019 |
| CN | 110189684 | A | 8/2019 |
| CN | 111063293 | A | 4/2020 |
| CN | 111915987 | A | 11/2020 |
| CN | 211980172 | U | 11/2020 |
| CN | 112201206 | A | 1/2021 |

* cited by examiner

FOLDABLE DISPLAY PANEL AND DRIVING METHOD THEREOF, DISPLAY DEVICE AND ELECTRONIC APPARATUS

CROSS REFERENCE TO RELATED APPLICATIONS

The present application claims priority to Chinese patent application No. 202110343339.1 with the application date of Mar. 30, 2021, the entire content of which is incorporated herein by reference.

TECHNICAL FIELD

The present disclosure generally relates to the field of display technology, and in particular to a foldable display panel, a driving method for driving the same, a display device including the foldable display panel, and an electronic apparatus including the display device.

BACKGROUND

Organic Light Emitting Diode (OLED), also known as organic light emitting semiconductor, has the characteristics of self-luminescence, wide color gamut, and low power consumption. Therefore, it is widely used in smart phone TVs, wearable devices, VR and other fields. In addition, because OLED-based display panels are foldable and bendable, they are also attracting attention in the fields of foldable display and bendable display.

SUMMARY

According to the first aspect of the present disclosure, there is provided a foldable display panel including: k display areas, wherein each display area includes: a pixel array arranged in a form of an m×n array; j display area data signal lines, wherein each display area data signal line is configured to provide a data signal to at least one corresponding column of pixels in the pixel array. The foldable display panel also includes i display panel gate signal lines, wherein each display panel gate signal line is configured to provide a gate drive signal to at least one corresponding row of pixels in the pixel array of each display area; j display panel data signal lines, electrically connected with the j display area data signal lines, wherein each display panel data signal line is configured to provide a data signal to the foldable display panel; s1 data transmission control signal lines, wherein each data transmission control signal line is configured to provide a data transmission control signal; s2 data transmission control circuits, wherein each data transmission control circuit corresponds to at least one data transmission control signal line and at least one display area, and is configured to: in response to the data transmission control signal provided by the corresponding data transmission control signal line, bring the j display panel data signal lines into conduction with the display area data signal lines of at least one corresponding display area, respectively. k is an integer greater than 1, m and n are integers greater than 0, respectively, i is an integer greater than 0 and less than or equal to m, j is an integer greater than 0 and less than or equal to n, and s1 and s2 are both integers greater than 1 and less than or equal to k, and s1 is greater than or equal to s2.

In some exemplary embodiments, each of the i display panel gate signal lines is divided into k segments disconnected from each other, each segment forms a display area gate signal line of a corresponding display area, and the display area gate signal line is configured to provide a gate drive signal to at least one corresponding row of pixels in the pixel array of the corresponding display area.

In some exemplary embodiments, surrounding areas of each display area include a peripheral area surrounding it, and wherein each data transmission control circuit is located in the peripheral area of the at least one corresponding display area.

In some exemplary embodiments, surrounding areas of each display area include a peripheral area surrounding it, and wherein one of the k display areas is a master display area, and all data transmission control circuits are located in the peripheral area of the master display area.

In some exemplary embodiments, when the foldable display panel is folded, the master display area is used for display and the other display areas are not used for display.

In some exemplary embodiments, the foldable display panel includes two display areas.

In some exemplary embodiments, the values of the integers s1 and s2 are both equal to the value of the integer k, such that the foldable display panel includes k data transmission control signal lines and k data transmission control circuits, and wherein each data transmission control signal line corresponds to one data transmission control circuit and each data transmission control circuit corresponds to one display area.

In some exemplary embodiments, each data transmission control circuit includes j transistors, the first electrode of each transistor is connected with one of the j display panel data signal lines and the second electrode thereof is connected with one of the j display area data signal lines of a corresponding display area, and the control electrodes of the j transistors are connected with a corresponding data transmission control signal line of the k data transmission control signal lines.

In some exemplary embodiments, the j transistors are all P-type transistors

In some exemplary embodiments, the value of the integer i is equal to the value of the integer m and the value of the integer j is equal to the value of the integer n, such that the foldable display panel includes m display panel gate signal lines and n display panel data signal lines, and each display area includes n display area data signal lines, and wherein each display panel gate signal line is configured to provide a gate drive signal to a corresponding row of pixels in the pixel array of each display area, and each display area data signal line is configured to provide a data signal to a corresponding column of pixels in the pixel array.

In some exemplary embodiments, each of the m display panel gate signal lines is divided into k segments disconnected from each other, each segment forms a display area gate signal line of a corresponding display area, and the display area gate signal line is configured to provide a gate drive signal to a corresponding row of pixels in the pixel array of the corresponding display area.

According to the second aspect of the present disclosure, there is provided a display device including the foldable display panel provided according to the first aspect of the present disclosure. The display device further includes: a timing controller configured to generate first control signals, second control signals and image data; a gate driver configured to generate gate drive signals provided to the i display panel gate signal lines based on the first control signals; a data driver configured to, based on the second control signals and the image data, generate data signals provided to the j display panel data signal lines, and generate data transmission control signals provided to the s1 data transmission control signal lines.

In some exemplary embodiments, the gate driver includes a GOA circuit including i GOA units, each GOA unit corresponds to a display panel gate signal line and is configured to generate a gate drive signal provided to a corresponding display panel gate signal line.

In some exemplary embodiments, the value of the integer i is equal to the value of the integer m, the value of the integer j is equal to the value of the integer n, and the values of the integers s1 and s2 are both equal to the value of the integer k, such that the foldable display panel includes m display panel gate signal lines and n display panel data signal lines, each display area includes n display area data signal lines, the foldable display panel includes k data transmission control signal lines and k data transmission control circuits, and wherein each display panel gate signal line is configured to provide a gate drive signal to a corresponding row of pixels in the pixel array of each display area, each display area data signal line is configured to provide a data signal to a corresponding column of pixels in the pixel array, and each data transmission control signal line corresponds to one data transmission control circuit, and each data transmission control circuit corresponds to one display area.

According to the third aspect of the present disclosure, there is provided a display device including the foldable display panel provided according to the first aspect of the present disclosure, wherein each of the i display panel gate signal lines is divided into k segments disconnected from each other, each segment forms a display area gate signal line of a corresponding display area, and the display area gate signal line is configured to provide a gate drive signal to at least one corresponding row of pixels in the pixel array of the corresponding display area. The display device further includes: a timing controller configured to generate first control signals, second control signals and image data; k gate drivers, each gate driver corresponding to a display area and configured to generate a gate drive signal provided to a display area gate signal line of the display area based on the first control signals; a data driver configured to, based on the second control signals and the image data, generate data signals provided to the j display panel data signal lines, and generate data transmission control signals provided to the s1 data transmission control signal lines.

According to the fourth aspect of the present disclosure, there is provided an electronic apparatus, including the display device as described above.

According to the fifth aspect of the present disclosure, there is provided a driving method for driving the foldable display panel provided according to the first aspect of the present disclosure, including: determining display area(s) to be used for display from the k display areas; during a line scan time, making the data transmission control signal(s) provided by data transmission control signal line(s) of the k data transmission control signal lines and corresponding to the display area(s) to be used for display become active one by one; and during a line scan time, making a gate drive signal provided by a corresponding display panel gate signal line become active, after a last active data transmission control signal becomes inactive.

In some exemplary embodiments, the driving method further includes increasing pulse width of the data transmission control signal(s) and the gate drive signal when the number of the display area(s) to be used for display is less than k.

In some exemplary embodiments, the driving method further includes reducing the line scan time when the number of the display area(s) to be used for display is less than k.

In some exemplary embodiments, each of the m display panel gate signal lines is divided into k segments disconnected from each other, each segment forms a display area gate signal line of a corresponding display area, and the display area gate signal line is configured to provide a gate drive signal to a corresponding row of pixels in the pixel array of the corresponding display area, the driving method further includes applying gate drive signals to display area gate signal lines of the display area(s) to be used for display.

BRIEF DESCRIPTION OF DRAWINGS

By reading the detailed description of the non-limiting embodiments of the present disclosure with reference to the following drawings, other features, purposes and advantages of the present disclosure will become more apparent; in the drawings.

Figure 1:
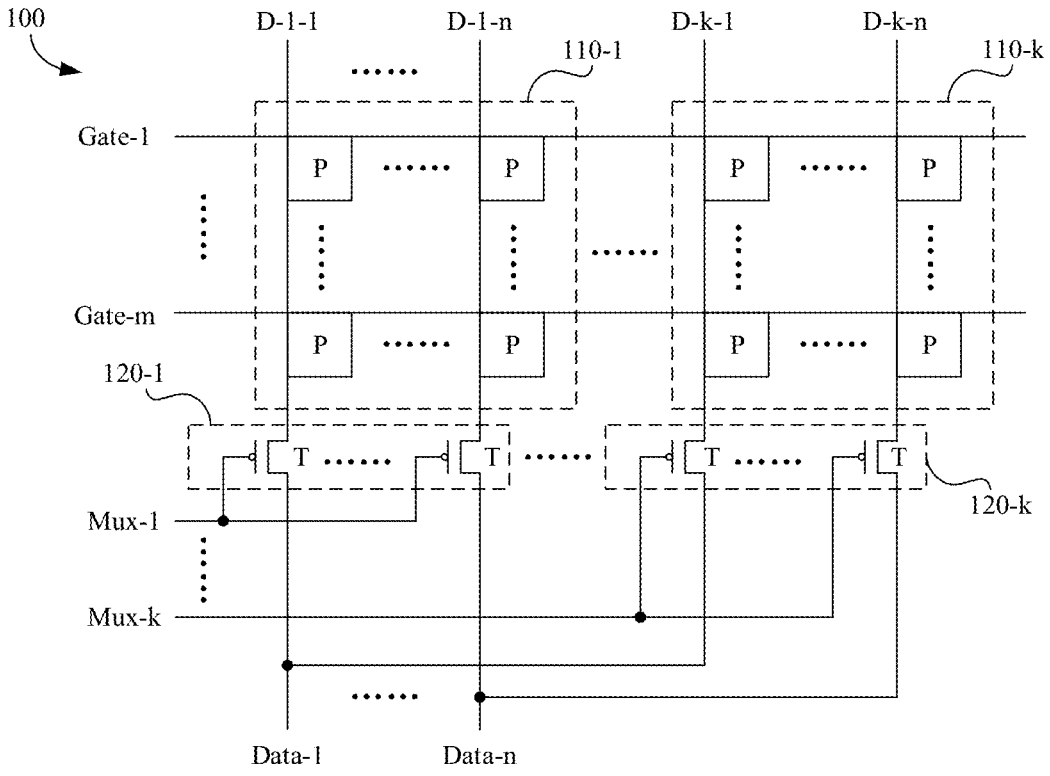
FIG. 1 schematically shows the structure of a foldable display panel provided according to an exemplary embodiment of the present disclosure.

It should be understood that the drawings are only used to schematically illustrate various exemplary embodiments according to the present disclosure, and therefore, they are not necessarily drawn to scale. In addition, throughout the drawings of the present disclosure, the same or similar reference numerals indicate the same or similar features.

DETAILED DESCRIPTION OF EMBODIMENTS

The present disclosure will be described in detail hereinafter with reference to the drawings and exemplary embodiments. It should be understood that the exemplary embodiments described herein are only used to explain and describe the present disclosure, and not to limit the present disclosure. It should also be understood that, for ease of description, only contents related to the present disclosure are shown in the drawings. In addition, it should be understood that the various exemplary embodiments of the present disclosure and the various features in the exemplary embodiments can be combined with each other, to the extent that they do not conflict.

With the development of OLED flexible screen technology and market demand, display devices with foldable functions are becoming more and more common. When in use, the foldable screen can be folded to an angle along a folding line according to the user's needs to meet the needs of the user for different screen sizes, and the folded display screen will not affect the portability. Compared with an ordinary screen, the display modes of a foldable screen is more diverse. A foldable screen is usually divided into a plurality of display areas, and these display areas can respectively form a master screen and a plurality of slave screens of the foldable screen. The master screen and the plurality of slave screens of the foldable screen can be used as the same screen for display at the same time, or only the master screen or only the slave screen(s) can be used for display after being folded.

Referring to FIG. 1, it schematically shows the structure of a foldable display panel provided according to an exemplary embodiment of the present disclosure. As shown in FIG. 1, the foldable display panel 100 includes k display areas 110-1 to **110-*k*. Each display area can be folded to an angle relative to an adjacent display area along a fold line to realize the foldable function of the foldable display panel 100. Throughout the present disclosure, k is an integer greater than 1, which will not be repeatedly stated hereinafter. As non-limiting examples, k may be 2 or 3. That is, in this case, the foldable display panel 100** may include two or three foldable display areas. The present disclosure does not limit the number of display areas included in the foldable display panel.

Each display area includes a plurality of pixels P, and these pixels P are arranged in the form of an m×n array to form a pixel array of the display area. In the pixel array, each row of pixels P may be arranged in a first direction, and each column of pixels P may be arranged in a second direction, and the first direction and the second direction intersect each other to form an angle. As a non-limiting example, the angle may be 90°. The present disclosure does not limit the angle at which the extension direction of the row and the extension direction of the column intersect in the pixel array. In addition, throughout the present disclosure, m and n are respectively integers greater than 0, which will not be repeatedly stated hereinafter. Each display area also includes n display area data signal lines. For example, the display area 110-1 includes the display area data signal lines D-1-1 to D-1-n, and by analogy, the display area **110-*k*** includes the display area data signal lines D-k-1 to D-k-n. Each display area data signal line is configured to provide a data signal to a corresponding column of pixels P in the pixel array of the corresponding display area.

The foldable display panel 100 includes the m display panel gate signal lines Gate-1 to Gate-m, wherein each display panel gate signal line is configured to provide a gate drive signal to a corresponding row of pixels P in the pixel array of each display area (e.g., each display area of the display areas 110-1 to **110-*k*) of the foldable display panel 100. The gate drive signal can be provided to the pixel drive circuit of each pixel P (which will be described in detail hereinafter), such that the data signal on the display area data signal line corresponding to the pixel P can be written into the pixel drive circuit during the period when the gate drive signal is at an active potential. The foldable display panel 100 includes the n display panel data signal lines Data-1 to Data-n, wherein each display panel data signal line is configured to provide a data signal to the foldable display panel 100**.

As shown in FIG. 1, the foldable display panel 100 further includes the k data transmission control signal lines Mux-1 to Mux-k, and further includes the k data transmission control circuits 120-1 to **120-*k*. Each data transmission control signal line corresponds to one data transmission control circuit so as to provide a data transmission control signal to the corresponding data transmission control circuit. In the foldable display panel 100 as shown, the data transmission control signal line Mux-1 provides a data transmission control signal to the data transmission control circuit 120-1, and by analogy, the data transmission control signal line Mux-k provides a data transmission control signal to the data transmission control circuit 120-*k*. Each of the data transmission control circuits 120-1 to 120-*k* also corresponds to one of the k display areas 110-1 to 110-*k***, and is configured to bring the n display panel data signal lines Data-1 to Data-n into conduction with the n display area data signal lines in a corresponding display area, respectively, in response to the data transmission control signal provided by the corresponding data transmission control signal line being active.

As shown in FIG. 1, each data transmission control circuit may include n transistors T. Each transistor has its first electrode connected with one of the n display panel data signal lines, its second electrode connected with one of the n display area data signal lines of the corresponding display area, and its control electrode connected with one of the k data transmission control signal lines. For example, for the data transmission control circuit 120-1, the first electrode of each transistor T is connected with one of the display panel data signal lines Data-1 to Data-n, the second electrode of each transistor T is connected with one of the display area data signal lines D-1-1 to D-1-n of the display area 110-1, and the control electrode of each transistor T is connected with the data transmission control signal line Mux-1. For the other data transmission control circuits, the transistors T included therein are connected with the corresponding display panel data signal lines, the corresponding display area data signal lines, and the corresponding data transmission control signal lines in a similar manner.

It should be understood that the term "active potential" used in the present disclosure refers to the potential at which the involved circuit element (for example, transistor) is enabled, and the term "inactive potential" as used herein refers to the potential at which the involved circuit element is disabled. For an N-type transistor, the active potential is a high potential, and the inactive potential is a low potential. For a P-type transistor, the active potential is a low potential, and the inactive potential is a high potential. It should also be understood that the active potential and the inactive potential are not intended to refer to a specific potential, but may contain a range of potentials. In addition, in the present disclosure, the terms "voltage", "voltage level" and "potential" may be used interchangeably.

In addition, it should also be understood that in the exemplary embodiment, although each transistor is illustrated and described as a P-type transistor, an N-type transistor is also possible. In the case of a P-type transistor, the turn-on voltage of the control electrode has a low level, and the turn-off voltage of the control electrode has a high level; correspondingly, in the case of an N-type transistor, the turn-on voltage of the control electrode has a high level, and the turn-off voltage of the control electrode has a low level. In addition, in each exemplary embodiment of the present disclosure, each transistor may take the form of, for example, a thin film transistor, which is typically manufactured such that its first and second electrodes can be used interchangeably. It should be understood that the use of thin film transistors is only an exemplary manner, and any other suitable elements, such as field effect transistors or other elements with the same characteristics, can also be used to implement the various circuit structures described in the present disclosure, which is not limited in the present disclosure.

Time Division Multiplexing (TDM) is a multiplexing manner that uses different time periods of the same physical connection to transmit different signals, and it is capable of achieving the purpose of transmitting a plurality of data signals by using a single line. In the foldable display panel 100 shown in FIG. 1, based on the data transmission control signal lines Mux-1 to Mux-k and the data transmission control circuits 120-1 to **120-*k*, the foldable display panel 100 can use the n display panel data signal lines Data-1 to Data-n to provide data signals to be displayed to the display areas to be used for display in the display areas 110-1 to 110-*k***, respectively, in a time-division multiplexing manner.

Figure 2:
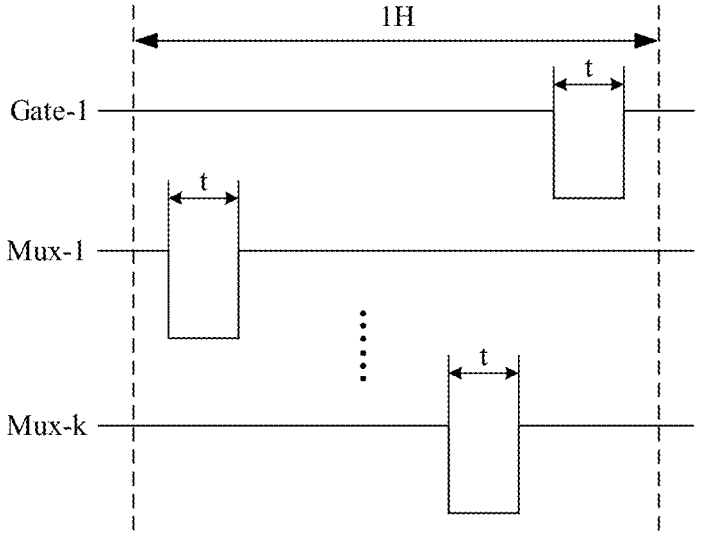
FIG. 2 schematically shows a time-division multiplexing signal timing sequence that can be used to provide data signals for the foldable display panel shown in FIG. 1.

Referring to FIG. 2, it schematically shows a time-division multiplexing signal timing sequence that can be used to provide data signals for the first row of pixels of the pixel array of each display area in the foldable display panel 100 shown in FIG. 1. It should be understood that a similar time-division multiplexing signal timing sequence may be used to provide data signals to the other rows of pixels of the pixel array. As shown in FIG. 2, this time-division multiplexing process is completed within a single line scan time 1H corresponding to the refresh frequency. Regarding the line scan time, as a non-limiting example, if the pixel array of each display area in the foldable display panel has 560 rows and the refresh frequency of the foldable display panel is 90 Hz, the refresh time of a frame is about 1/90 Hz≈0.011 second, from which the line scan time of a row can be calculated as 0.011/560≈19.8 microseconds. Thus, the line scan time depends on the number of rows of the pixel array in the foldable display panel and the refresh frequency of the foldable display panel. The specific value of the line scan time is not limited in the present disclosure.

As shown in FIG. 2, the data transmission control signals provided by the k data transmission control signal lines Mux-1 to Mux-k become active one by one within the line scan time 1H. It should be noted that the expression "(become) active one by one" in present disclosure refers to the situation in which a plurality of signals become active in turn during a time period and a signal becomes active only after the previous signal becomes inactive. Specifically, in the time-division multiplexing signal timing sequence shown in FIG. 2, during the line scan time 1H, the data transmission control signal provided by the data transmission control signal line Mux-1 first becomes active and becomes inactive after the time period t, then the data transmission control signal provided by the next data transmission control signal line becomes active and becomes inactive after the time period t, and by analogy, the data transmission control signal provided by the data transmission control signal line Mux-1 finally becomes active and then becomes inactive after the time period t. After the data transmission control signal provided by the data transmission control signal line Mux-k becomes inactive, the gate drive signal transmitted by the display panel gate signal line Gate-1, which is used for providing the gate drive signal to the first row of pixels of the pixel array of each display area in the foldable display panel 100, becomes active, so that the data signals that have been provided to the various display area data signal lines of the display areas 110-1 to **110-*k*** are written into the pixel drive circuits of the first row of pixels of the pixel array of the various display areas.

It should be understood that for the foldable display panel 100 shown in FIG. 1, only some of the display areas may be used for display. In this case, the foldable display panel 100, when providing the data transmission control signals by controlling the k data transmission control signal lines Mux-1 to Mux-k, can make only the data transmission control signals provided by the data transmission control signal lines corresponding to the display areas to be used for display become active, thereby providing data signals only to the display areas to be used for display, without providing data signals to the display areas not for display. As a result, the foldable display panel 100 can reduce the power consumption of drive chips and improve the service life of driver chips.

Figure 3:
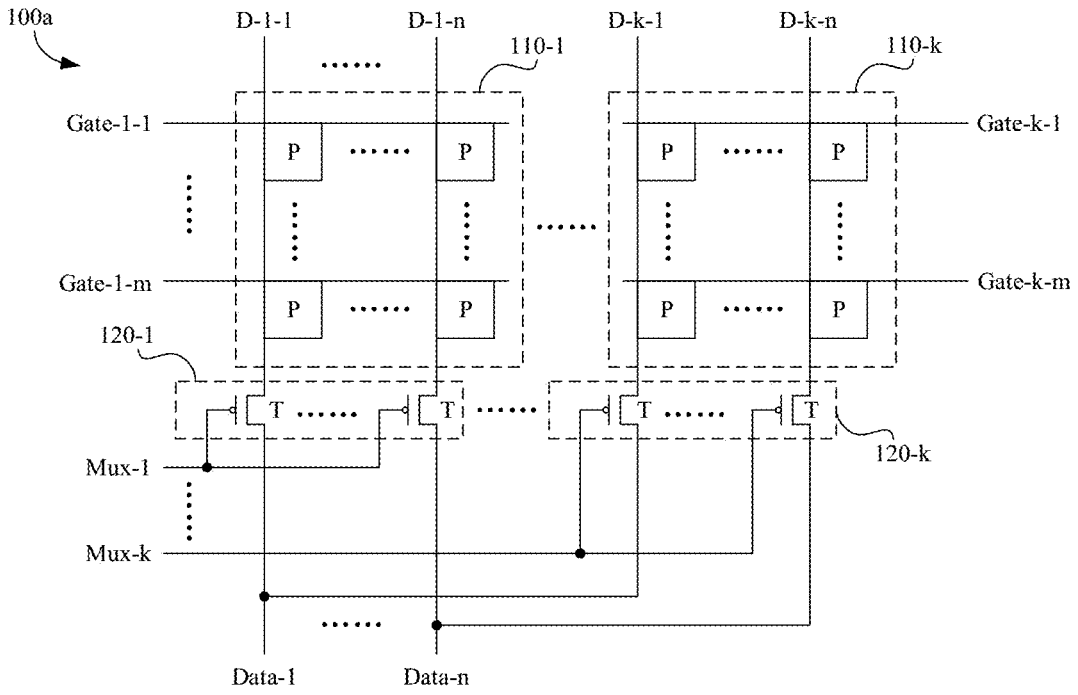
FIG. 3 schematically shows the structure of a foldable display panel provided according to another exemplary embodiment of the present disclosure.

Referring to FIG. 3, it schematically shows the structure of a foldable display panel provided in accordance with another exemplary embodiment of the present disclosure. As shown in FIG. 3, the structure of the foldable display panel **100*a* is similar to that of the foldable display panel 100 shown in FIG. 1, and the difference therebetween is only the structure of the gate signal lines used to provide the gate drive signals. Therefore, only the above-mentioned difference of the foldable display panel 100*a*** will be described hereinafter, and the same structures will not be repeatedly described.

In the foldable display panel **100*a*, each of the m display panel gate signal lines is divided into k segments disconnected from each other. These segments of the display panel gate signal lines form the display area gate signal lines in each of the display areas 110-1 to 110-*k*, respectively. For example, for the display area 110-1, it includes the display area gate signal lines Gate-1-1 to Gate-1-m, and by analogy, for the display area 110-*k***, it includes the display area gate signal lines Gate-k-1 to Gate-k-m. The display area gate signal line in each display area is configured to provide a gate drive signal to a corresponding row of pixels in the pixel array of that display area.

For the foldable display panel **100*a* shown in FIG. 3, in the case that only some of the display areas are used for display, the foldable display panel 100*a* can perform the line scanning only on the pixel arrays of the display areas to be used for display, without performing the line scanning on the pixel arrays of the display areas not for display. As a result, the foldable display panel 100***a* can further reduce power consumption.

It should be understood that the foldable display panels shown in FIGS. 1 and 3 are merely exemplary and non-limiting, and thus the various parts of the foldable display panels may have other arrangements. For example, one or more of the display area data signal lines, the display panel gate signal lines, the display panel data signal lines, the data transmission control signal lines, and the data transmission control circuits may be arranged to have different correspondences among them. In some exemplary embodiments, the number of the display area data signal lines for each display area may be less than the number of the pixel columns of the pixel array, whereby each display area data signal line can be configured to provide a data signal to at least one corresponding column of pixels in the pixel array. In other exemplary embodiments, the number of the display panel gate signal lines may be less than the number of the pixel rows of the pixel array, whereby each display panel gate signal line can be configured to provide a gate drive signal to at least one corresponding row of pixels in the pixel array of each display area. In addition, a display area gate signal line can also be configured to provide a gate drive signal to at least one corresponding row of pixels in the pixel array of the corresponding display area. In other exemplary embodiments, the data transmission control circuits, the data transmission control signal lines and the display areas may not have a one-to-one correspondence. For example, but not limited to, each data transmission control circuit may correspond to at least one data transmission control signal line and at least one display area.

In addition, the foldable display panels 100, 100*a* shown in FIGS. 1 and 3 each include the k display areas 110-1 to 110-*k* and the corresponding k data transmission control circuits 120-1 to 120-*k*. Each data transmission control circuit may be arranged in the peripheral area of a corresponding display area. However, in other exemplary embodiments, one of the k display areas 110-1 to 110-*k* may be defined as a master display area, and the k data transmission control circuits 120-1 to 120-*k* may all be arranged in the peripheral area of the master display area. Further, as a non-limiting example, when the master display area is present, the master display area is used for display when the foldable display panel is folded, and the other display areas are not used for display.

Figure 4:
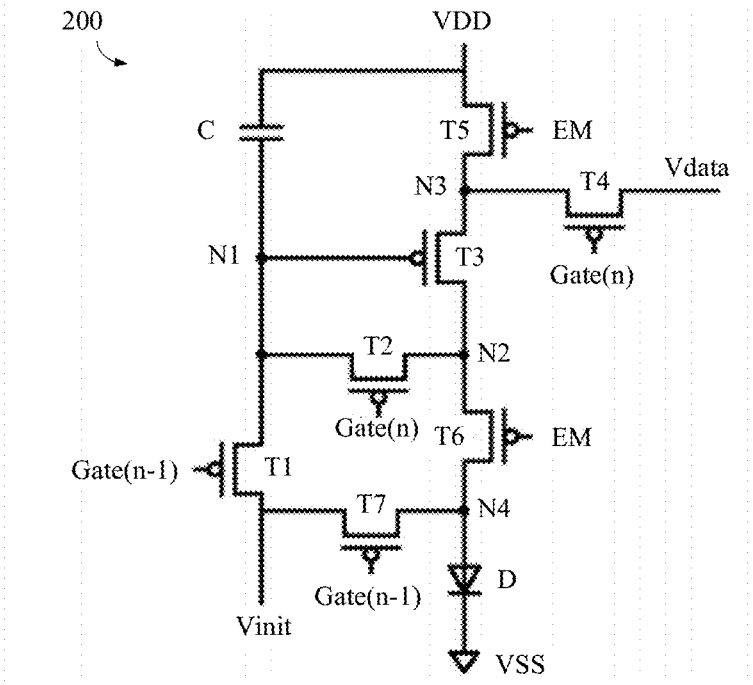
FIG. 4 schematically shows the structure of an exemplary pixel drive circuit, which may be used in a foldable display panel provided according to various exemplary embodiments of the present disclosure.

Referring to FIG. 4, it schematically shows the structure of an exemplary pixel drive circuit, which can be used, for example, in the foldable display panels 100, 100*a* shown in FIGS. 1 and 3.

As shown in FIG. 4, the pixel drive circuit 200 includes a first transistor T1, a second transistor T2, a third transistor T3, a fourth transistor T4, a fifth transistor T5, a sixth transistor T6, a seventh transistor T7, a storage capacitor C, and a light emitting diode D. A first electrode of the first transistor T1 is applied with an initialization voltage signal Vinit, and a second electrode thereof is connected with a first node N1, and a control electrode thereof is applied with the gate drive signal of the previous stage Gate(n−1), which is the gate drive signal applied to the previous row of the pixel array. A first electrode of the second transistor T2 is connected with the first node N1, and a second electrode thereof is connected with a second node N2, and a control electrode thereof is applied with the gate drive signal Gate(n), which is the gate drive signal applied to the current row of the pixel array. A first electrode of the third transistor T3 is connected with a third node N3, a second electrode thereof is connected with the second node N2, and a control electrode thereof is connected with the first node N1. A first electrode of the fourth transistor T4 is connected with the third node N3, a second electrode thereof is applied with the data voltage signal Vdata, and a control electrode thereof is applied with the gate drive signal Gate(n). A first electrode of the fifth transistor T5 is applied with the first power supply voltage signal VDD, a second electrode thereof is connected with the third node N3, and the control electrode thereof is applied with the lighting control signal EM. A first electrode of the sixth transistor T6 is connected with the second node N2, a second electrode thereof is connected with a fourth node N4, and a control electrode thereof is applied with the lighting control signal EM. A first electrode of the seventh transistor T7 is applied with the initialization voltage signal Vinit, a second electrode thereof is connected with the fourth node N4, and a control electrode thereof is applied with the gate drive signal of the previous stage Gate(n−1). A first electrode of the storage capacitor C is applied with the first power supply voltage signal VDD, and a second electrode thereof is connected with the first node N1. A first electrode of the light emitting diode D is connected with the fourth node N4, and a second electrode thereof is applied with a second power supply voltage signal VSS. As a non-limiting example, the light emitting diode D may, for example, be an organic light emitting diode.

It should be understood that in this exemplary embodiment, although various transistors are illustrated and described as P-type transistors, N-type transistors are also possible. It should also be understood that suitable pixel drive circuits with other structures may be applied to the foldable display panel 100, 100*a*, such as a pixel drive circuit including six transistors and a storage capacitor (i.e., a 6T1C pixel drive circuit), or a pixel drive circuit including eight transistors and a storage capacitor (i.e., an 8T1C pixel drive circuit).

Figure 5:
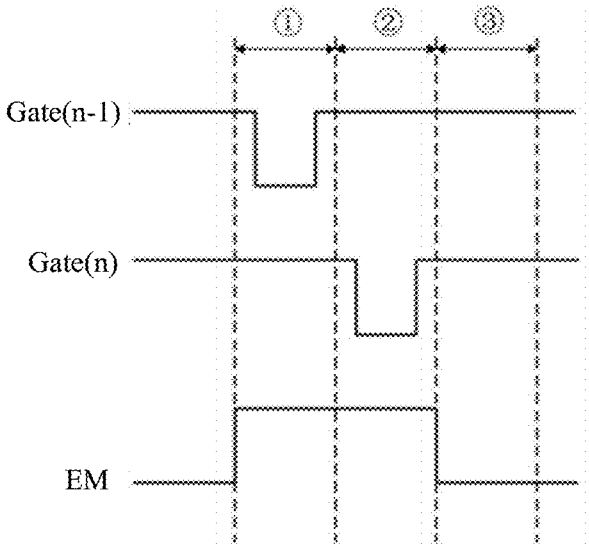
FIG. 5 schematically shows a timing sequence of signals that can be used in the pixel drive circuit shown in FIG. 4.

Referring to FIG. 5, it schematically shows the signal timing sequence that can be applied to the pixel drive circuit shown in FIG. 4.

As shown in FIG. 5, the operating process of the pixel drive circuit 200 shown in FIG. 4 may include the following three phases:

1) Reset Phase.

When the gate drive signal of the previous stage Gate(n−1) is active, the first transistor T1 and the seventh transistor T7 are turned on. The initialization voltage signal Vint is transmitted to the control electrode of the third transistor T3 and the first electrode of the light emitting diode D through the first transistor T1 and the seventh transistor T7, respectively, in order to reset the first electrode of the light emitting diode D and the control electrode of the third transistor T3. At this time, the voltage at the first electrode of the light emitting diode D and the voltage at the control electrode of the third transistor T3 are both equal to Vint.

2) Voltage Compensation Phase

When the gate drive signal Gate(n) is active, the fourth transistor T4 and the second transistor T2 are turned on. In the case that the second transistor T2 is turned on, the control electrode of the third transistor T3 is electrically connected to the second electrode thereof, thereby making the third transistor T3 in the diode conduction state. At this time, the data voltage signal Vdata is written to the first node N1 (or the control electrode of the third transistor T3) through the fourth transistor T4 that is turned on, the third transistor T3 that is in the diode conduction state and the second transistor T2 that is turned on, and compensation of the threshold voltage Vth of the third transistor T3 is realized.

Specifically, during the voltage compensation phase, the voltage at the first electrode of the third transistor T3 is Vs=Vdata. Since the third transistor T3 is in the diode conduction state, it is known from the conduction characteristics of a transistor that the voltage at the second electrode of the third transistor T3 is Vd=Vdata−|Vth|. Since the second transistor T2 is also turned on, the voltage Vg at the control electrode of the third transistor T3 is the same as the voltage Vd at its second electrode. Therefore, the voltage at the control electrode of the third transistor T3 (or the voltage at the first node N1) is Vg=Vdata−|Vth|. Thus, the compensation of the threshold voltage Vth of the third transistor T3 can be achieved.

3) Light Emitting Phase

When the lighting control signal EM is active, the sixth transistor T6 and the fifth transistor T5 are turned on, so that the current path between the first power supply voltage signal VDD and the second power supply voltage signal VSS is in conduction. The drive current generated by the third transistor T3 flows through the above-mentioned current path to drive the light emitting diode D to emit light.

During the light emitting phase, the voltage at the first electrode of the third transistor T3 is Vs=VDD, and the voltage at its control electrode remains Vg=Vdata−|Vth|, so that the voltage difference between its first electrode and the control electrode is Vsg=Vs−Vg=VDD−(Vdata−|Vth|).

Therefore, the drive current flowing through the light emitting diode D can be calculated according to the following equation:

$$I=\tfrac{1}{2}*\mu*Cox*W/L*(Vsg-Vth)^2 \quad \text{(Equation 1)}$$

wherein μ is the carrier mobility of the third transistor T3, Cox is the capacitance between the gate and the channel of the third transistor T3, W/L is the width-to-length ratio of the third transistor T3, Vsg is the voltage difference between the first electrode and the control electrode of the third transistor T3, and Vth is the threshold voltage of the third transistor T3.

Bringing the voltage difference Vsg between the first electrode and the control electrode of the third transistor T3 already obtained above into Equation 1, the following equation can be obtained:

$$I=K(V\text{data}+Vth-VDD-Vth)^2=K(V\text{data}-VDD)^2 \quad \text{(Equation 2)}$$

wherein K is the structure parameter factor, which represents the result of the calculation of the parameters μ, Cox, and W/L involving the structure of the transistor as described above, has a stable value in the structure of the same transistor and therefore can be used as a constant. As can be seen from Equation 2, in the light emitting phase, the amount of the drive current I flowing through the light emitting diode D depends only on the difference between the first power supply voltage signal VDD and the data voltage signal Vdata, independent of the threshold voltage Vth of the third transistor T3, since it is already compensated for during the voltage compensation phase.

Since the driving current I flowing through the light emitting diode D in the pixel drive circuit 200 is independent of the threshold voltage Vth of the drive transistor T3, the problem of uneven luminance due to the differences among the threshold voltages of the driving transistors of various pixels can be solved. For the pixel drive circuit 200, the longer the time in the voltage compensation phase (i.e. the longer the time that the gate drive signal Gate(n) is active), the longer the time to write the threshold-compensated voltage to the first node N1 by using the data voltage signal Vdata, and the better it is for the storage capacitor C to maintain a stable voltage at the first node N1.

Combined with reference to the time-division multiplexing timing sequence shown in FIG. 2, for the foldable display panels 100, 100*a* shown in FIGS. 1 and 3, when only some of the display areas are used for display, if the line scan time 1H is constant, the width of the active pulses of the data transmission control signal and the gate drive signal (i.e., the time period t shown in FIG. 2) can be increased, so that the threshold voltage compensation time for the pixel drive circuit can be increased to avoid causing display defects; or if the width of the above-mentioned active pulses is constant, the line scan time 1H can be reduced so that a high refresh frequency display can be realized. These aspects will be described in detail hereinafter.

As a non-limiting example, the foldable display panels 100, 100*a* according to the present disclosure may include the left and right display areas that are foldable. In this case, if the foldable display panel 100, 100*a* has a total of 1080 columns of pixels, 540 columns of pixels are provided in each display area such that the first display panel data signal line can provide a data signal to the first column of pixels and the 541st column of pixels, respectively, and the second display panel data signal line can provide a data signal to the second column of pixels and the 542nd column of pixels, respectively, and so on. In this non-limiting example, there are two data transmission control signal lines and two data transmission control circuits, which are used for providing data signals to the left display area and the right display area, respectively. When a single side display area is required for display, only the corresponding data transmission control signal line and data transmission control circuit need to be controlled to provide data signals to only the display area used for display.

It should be understood that the folding manners of the foldable display panel according to the present disclosure may include being folded left and right, being folded up and down, being folded in thirds or folded in fourths, which is not limited in the present disclosure. After being folded, the display area of the foldable display panel facing upward is generally used as the master display area and the other display area(s) is(are) used as the slave display area(s). The foldable display panel can control the master display area for display while leaving the slave display area(s) not for display to save power consumption. Further, it should be understood that the various display areas of the foldable display panel provided according to the present disclosure are not limited to being arranged sequentially from left to right along one direction as described in the exemplary embodiment, but may also be arranged sequentially from right to left along the direction, or sequentially from top to bottom along a direction perpendicular to the direction. In the various arrangements, the structure of the foldable display panel is substantially the same as that of the exemplary embodiments in the present disclosure, and only adaptive adjustments are required to accommodate changes in the folding direction of the display areas, which will not be repeatedly described herein.

Figure 6:
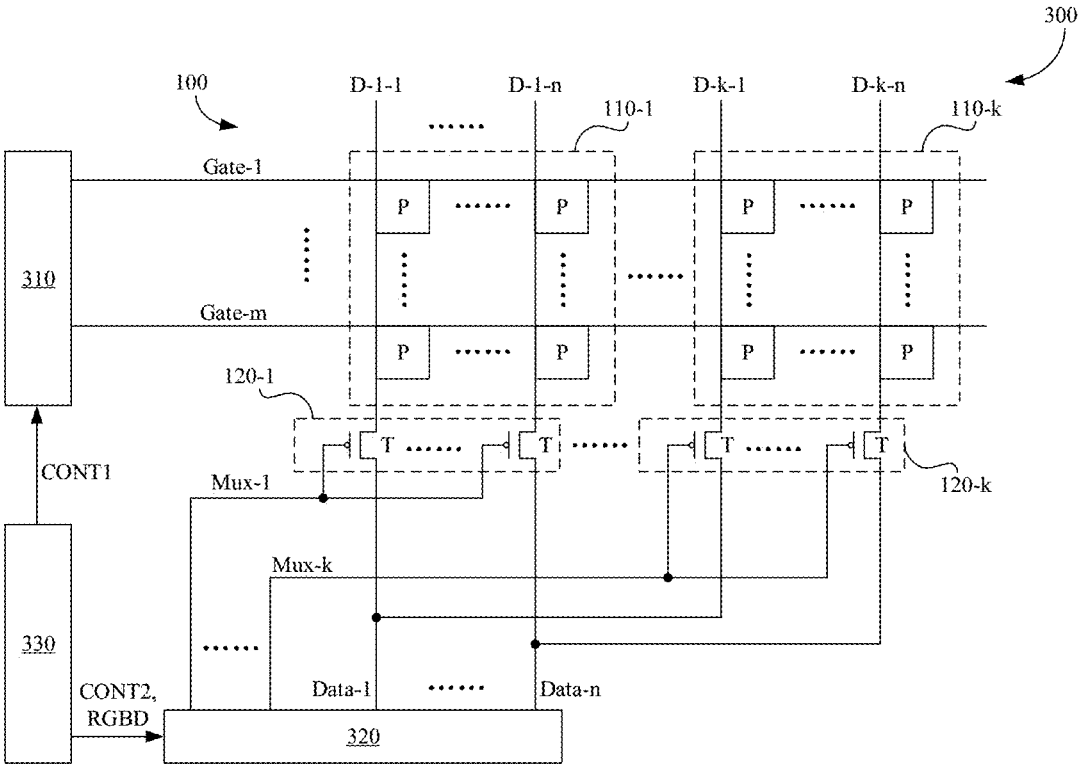
FIG. 6 schematically shows the structure of a display device provided according to an exemplary embodiment of the present disclosure.

Referring to FIG. 6, it schematically shows the structure of a display device provided in accordance with an exemplary embodiment of the present disclosure. As shown in FIG. 6, the display device 300 includes the foldable display panel 100 shown in FIG. 1, and also includes a gate driver 310, a data driver 320, and a timing controller 330. The gate driver 310 is configured to generate gate drive signals provided to the m display panel gate signal lines Gate-1 to Gate-m of the foldable display panel 100 based on the control signals received from the timing controller 330. Data driver 320 is configured to generate data signals provided to the n display panel data signal lines Data-1 to Data-n of the foldable display panel 100, and to generate data transmission control signals provided to the k data transmission control signal lines Mux-1 to Mux-k of the foldable display panel 100, based on control signals and image data received from timing controller 330. The timing controller 330 is configured to generate the corresponding control signals and image data to control the operation of the foldable display panel 100, the gate driver 310 and the data driver 320.

The timing controller 330 may receive input image data and input control signals from an external device (for example, a host computer). The input image data may include a plurality of input pixel data for a plurality of pixels. Each input pixel data may include red grayscale data R, green grayscale data G, and blue grayscale data B for a corresponding one of the plurality of pixels. The input control signals may include a master clock signal, a data enable signal, a vertical synchronization signal, a horizontal synchronization signal, and the like. The timing controller 330 generates the image data RGBD, the first control signals CONT1, and the second control signals CONT2 based on the input image data and the input control signals. The implementation of the timing controller 330 is known in the art. The timing controller 330 can be implemented in many ways (e.g., such as using dedicated hardware) to perform the various functions discussed herein. A "processor" is an example of the timing controller 330 employing one or more microprocessors, and the microprocessors may be programmed by using software (e.g., microcode) to perform various functions discussed herein. However, the timing controller 330 may be implemented with or without a processor, and may also be implemented as a combination of dedicated hardware to perform some functions and a processor to perform other functions. Examples of the timing controller 330 may include, but are not limited to, conventional microprocessors, application-specific integrated circuits (ASICs), and field-programmable gate arrays (FPGAs).

The gate driver 310 receives the first control signals CONT1 from the timing controller 330. The first control signals CONT1 may include various clock signals as required. The gate driver 310 generates gate drive signals output to the m display panel gate signal lines Gate-1 to Gate-m based on the first control signals CONT1. The gate driver 310 may sequentially provide the plurality of gate drive signals to the m display panel gate signal lines Gate-1 to Gate-m, respectively.

The data driver 320 receives the second control signals CONT2 and the image data RGBD output from timing controller 330. Based on the second control signals CONT2 and the image data RGBD as output, the data driver 330 generates data signals provided to the n display panel data signal lines Data-1 to Data-n of the foldable display panel 100, and generates data transmission control signals provided to the k data transmission control signal lines Mux-1 to Mux-k of the foldable display panel 100.

In each exemplary embodiment, the gate driver 310 and/or data driver 320 may be provided on the foldable display panel 100 or may be connected to the foldable display panel 100 with the aid of, for example, a Tape Carrier Package (TCP). As a non-limiting example, the gate driver 310 may include a gate driver on array (GOA) circuit integrated into the foldable display panel 100.

The GOA circuit is a type of driver circuit in which the gate driver ICs are directly fabricated on the array substrate to replace the driver chip formed by external wafers to realize progressive scanning. The GOA circuit can reduce the soldering process of external integrated chips, thus can realize narrow frame edge display and reduce the manufacture cost of driver circuits. Compared to conventional COF and COG processes, the GOA circuit not only saves cost, but is also extremely beneficial for increasing productive capacity and improving the integration of display panels since the gate orientation binding process can be omitted. In addition, the GOA circuit reduces the amount of gate driver ICs used, thus reducing power consumption and cost.

The GOA circuit is typically formed by cascading a plurality of GOA units, with each GOA unit corresponding to a row of pixels in a pixel array. In each exemplary embodiment of the present disclosure, each display area of the foldable display panel has a plurality of display panel gate signal lines arranged along a first direction and used to provide gate drive signals and a plurality of display area data signal lines arranged along a second direction and used to transmit data signals. The gate drive signal and the data signal are used to allow the light emitting device (for example, OLED) of a corresponding pixel to emit light to enable the pixel to be used for display. The first direction and the second direction intersect to form an angle, for example, the first direction and the second direction intersect perpendicularly. Further, in each exemplary embodiment of the present disclosure, the first direction and the second direction may be interchangeable.

The start signal of the GOA circuit generally starts from the GOA unit of the first row and generates a row-by-row shifted output signal downward through the shift register circuit in the GOA circuit. Alternatively, the GOA circuit can start from the GOA unit of the last row and generate a row-by-row shifted output signal upward through the shift register circuit in the GOA circuit. In addition, the GOA circuit can realize forward scanning or reverse scanning of the various rows in the pixel array by forward scanning control signals and reverse scanning control signals.

Figure 7:
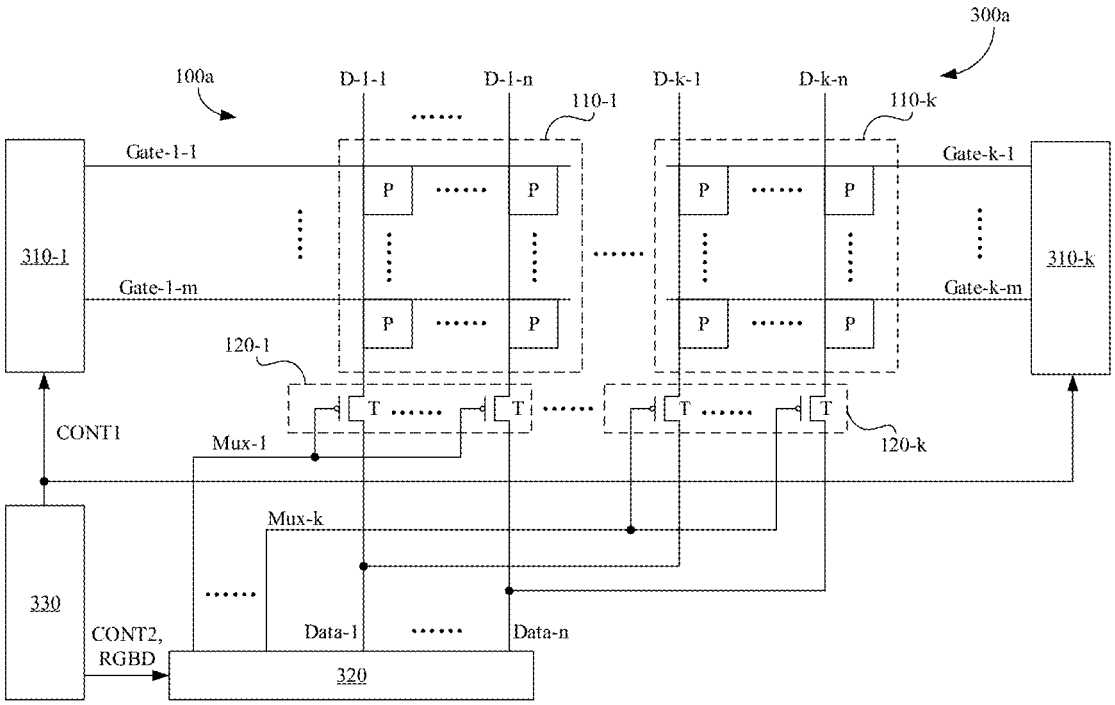
FIG. 7 schematically shows the structure of a display device provided according to another exemplary embodiment of the present disclosure.

Referring to FIG. 7, it schematically shows the structure of a display device provided according to another exemplary embodiment of the present disclosure. As shown in FIG. 7, the display device 300*a* includes the foldable display panel 100*a* shown in FIG. 3, and further includes k gate drivers 310-1 to 310-*k*, a data driver 320, and a timing controller 330. Each of the k gate drivers 310-1 to 310-*k* corresponds to one display area, and is configured to generate gate drive signals provided to the display area gate signal lines of the display area based on the control signals received from the timing controller 330. The data driver 320 is configured to: based on the control signal and the image data received from the timing controller 330, generate data signals provided to the n display panel data signal lines Data-1 to Data-n of the foldable display panel 100*a*, and generate data transmission control signals provided to the k data transmission control signal lines Mux-1 to Mux-k of the foldable display panel 100*a*. The timing controller 330 is configured to generate corresponding control signals and image data to control the operations of the foldable display panel 100*a*, the k gate drivers 310-1 to 310-*k*, and the data driver 320. The operations of the data driver 320 and the timing controller 330 in the display device 300*a* are similar to the operations of the data driver 320 and the timing controller 330 in the display device 300 shown in FIG. 6, which will not be repeatedly described herein.

In the display device 300*a*, the first control signals CONT1 generated by the timing controller 330 are provided to each of the k gate drivers 310-1 to 310-*k*. The gate drivers receive the first control signals CONT1 from the timing controller 330. The first control signals CONT1 may include various clock signals as required. Each of the gate drivers 310-1 to **310-*k* generates a gate drive signal provided to the m display area gate signal lines of the corresponding display area based on the received first control signals CONT1. Thus, for the display device 300*a*, in the case that only some of the display areas are used for display, the display device 300*a* can only perform line scanning of the pixel array of the display area(s) to be used for display, without performing line scanning of the pixel array of the display areas not for display. As a result, the display device 300*a*** can further reduce power consumption.

Figure 8:
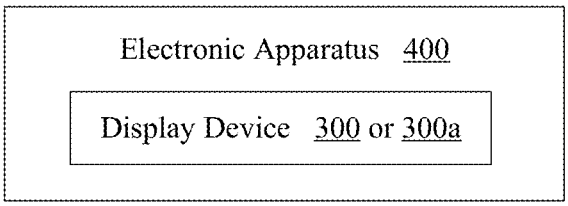
FIG. 8 schematically shows the structure of an electronic apparatus in the form of a block diagram.

Referring to FIG. 8, it schematically shows the structure of an electronic apparatus in the form of a block diagram. As shown in FIG. 8, the electronic apparatus 400 may include the display device 300 shown in FIG. 6 or the display device **300*a* shown in FIG. 7. It should be understood that the electronic apparatus 400** may be any suitable electronic apparatus that includes a display device, including, but not limited to: a cell phone, a tablet computer, a television, a monitor, a laptop computer, a digital photo frame, a navigator, and the like, which is not limited in the present disclosure.

Figure 9:
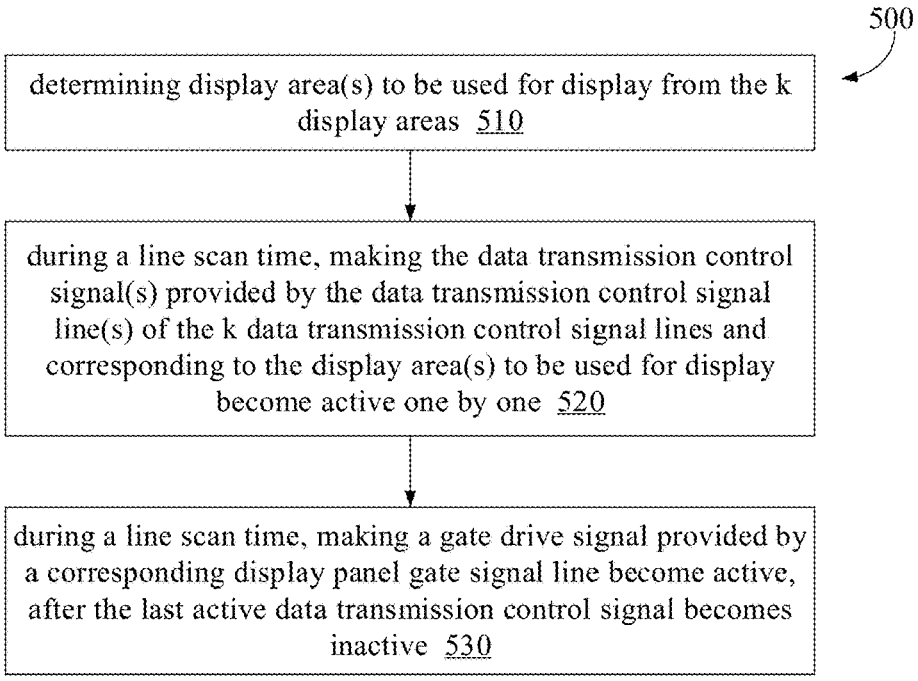
FIG. 9 schematically shows in the form of a flowchart, a driving method provided according to an exemplary embodiment of the present disclosure, which can be used to drive a foldable display panel provided according to various exemplary embodiments of the present disclosure.

Referring to FIG. 9, it schematically shows, in the form of a flowchart, a driving method provided in accordance with an exemplary embodiment of the present disclosure, which may be used to drive the foldable display panels 100, **100*a* according to the various exemplary embodiments of the present disclosure. As shown in FIG. 9, the driving method 500 may include steps 510, 520, and 530**:

step 510, determining display area(s) to be used for display from the k display areas;

step 520, during a line scan time, making the data transmission control signal(s) provided by the data transmission control signal line(s) of the k data transmission control signal lines and corresponding to the display area(s) to be used for display become active one by one; and step 530, during a line scan time, making a gate drive signal provided by a corresponding display panel gate signal line become active, after the last active data transmission control signal becomes inactive.

At step 510, as a non-limiting example, the display area(s) to be used for display may be determined based on the output of the sensor that senses whether the foldable display panel 100 or **100*a* is in a folded state. For example, when one of the k display areas of the foldable display panel 100 or 100*a* is the master display area, and when the foldable display panel 100 or 100*a*** is in a folded state, only the master display area may be used for display. In another non-limiting example, the display area(s) of the k display areas to be used for display can be designated as needed. The present disclosure does not limit how to determine the display area(s) to be used for display.

At step 520, making the data transmission control signal(s) become active one by one means that the data transmission control signal(s) provided by the data transmission control signal line(s) of the k data transmission control signal lines and corresponding to the display area(s) to be used for display become active in turn during the line scan time, and a signal becomes active only after the previous signal becomes inactive. As a result, under the control of the data transmission control signal lines, one by one, the n display area data signal lines of the various display area(s) to be used for display among the k display areas are respectively in conduction with the n display panel data signal lines Data-1 to Data-n of the foldable display panel 100 or **100*a***.

At step 530, the data signal on each display area data signal line is written into respective pixel drive circuits of the corresponding row of pixels in the pixel array by making the gate drive signal provided by the corresponding one display panel gate signal line become active.

Thus, the driving method 500 can provide the data signals to be displayed to the display area(s) to be used for display in the display areas 110-1 to **110-*k*** respectively by using the n display panel data signal lines Data-1 to Data-n based on a time-division multiplexing manner, thereby being capable of reducing power consumption.

Figure 10:
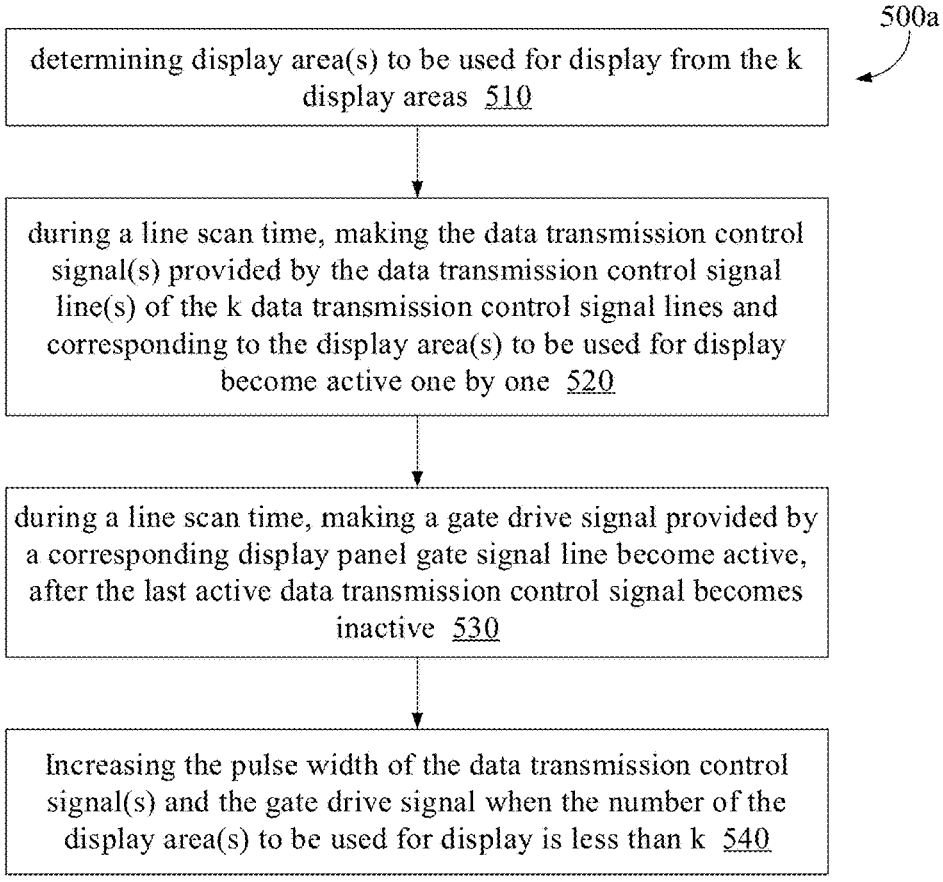
FIG. 10 schematically shows in the form of a flowchart, a driving method provided according to another exemplary embodiment of the present disclosure, which can be used to drive a foldable display panel provided according to various exemplary embodiments of the present disclosure.

Referring to FIG. 10, it schematically shows, in the form of a flowchart, a driving method that is provided according to another exemplary embodiment of the present disclosure and can be used to drive the foldable display panels 100, **100*a* according to the various exemplary embodiments of the present disclosure. The driving method 500*a* shown in FIG. 10 is substantially the same as the driving method 500 shown in FIG. 9, differing only in that the driving method 500*a* further includes step 540**: increasing the pulse width of the data transmission control signal(s) and the gate drive signal when the number of the display area(s) to be used for display is less than k.

Figure 11:
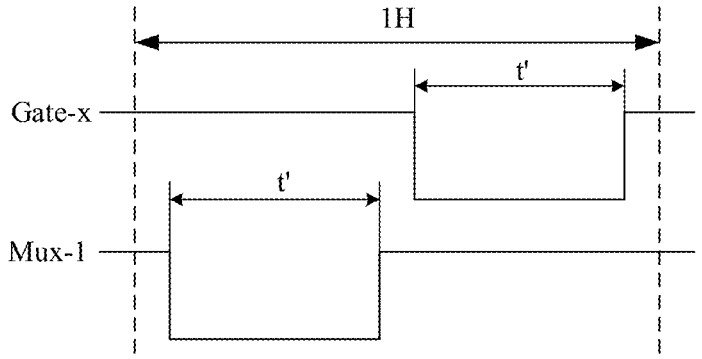
FIG. 11 schematically shows a time-division multiplexing signal timing sequence applicable to the driving method shown in FIG. 10.

Referring to FIG. 11, and in conjunction with reference to FIG. 2, FIG. 11 schematically shows the time-division multiplexing signal timing sequence used in the driving method shown in FIG. 10. In the time-division multiplexing signal timing sequence shown in FIG. 11, only the display area 110-1 is used for display, so only the data transmission control signal provided by the data transmission control signal line Mux-1 needs to be active and subsequently the gate drive signal provided by one of the m display panel gate signal lines Gate-x becomes active. Thus, for the line scan time 1H, the width of the active pulses of the data transmission control signal and the gate drive signal can be increased from the time period t shown in FIG. 2 to the time period t' shown in FIG. 11. As a result, the threshold voltage compensation time in the pixel drive circuit can be increased to avoid causing any display defects.

Figure 12:
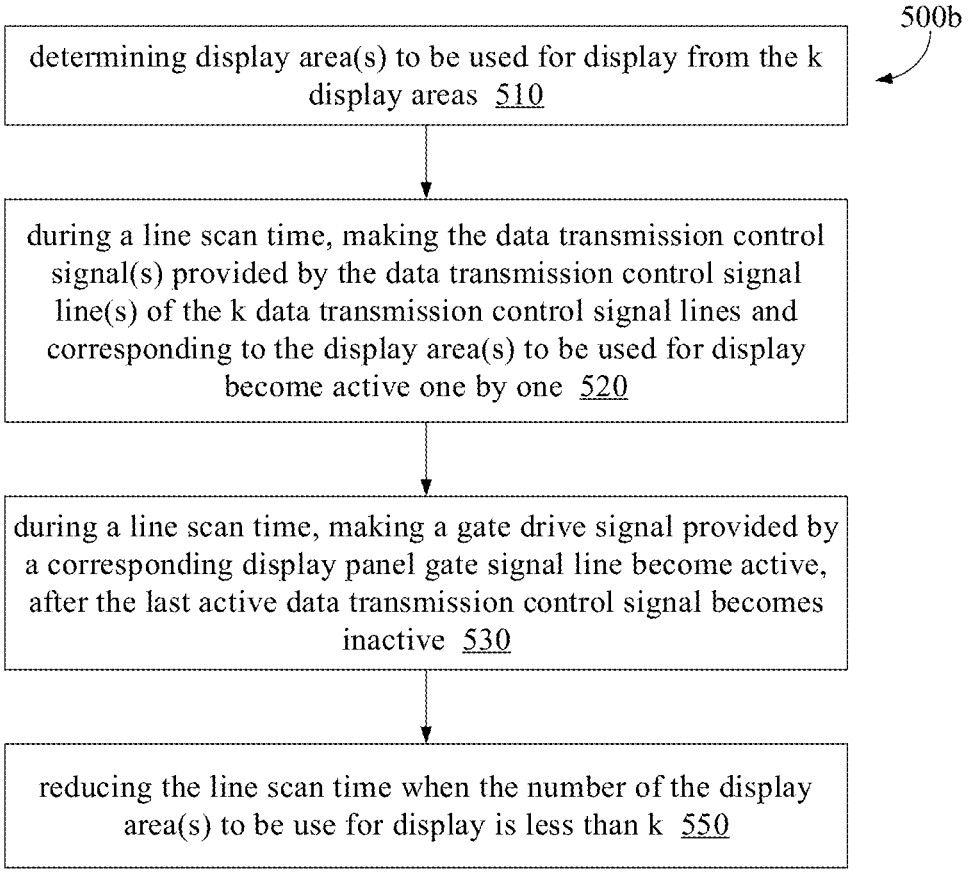
FIG. 12 schematically shows in the form of a flowchart, a driving method provided according to another exemplary embodiment of the present disclosure, which can be used to drive a foldable display panel provided according to various exemplary embodiments of the present disclosure.

Referring to FIG. 12, it schematically shows, in the form of a flowchart, a driving method that is provided according to another exemplary embodiment of the present disclosure and can be used to drive the foldable display panels 100, **100*a* according to the various exemplary embodiments of the present disclosure. The driving method 500*b* shown in FIG. 12 is substantially the same as the driving method 500 shown in FIG. 9, differing only in that the driving method 500*b* further includes step 550**: reducing the line scan time when the number of the display area(s) to be used for display is less than k.

Figure 13:
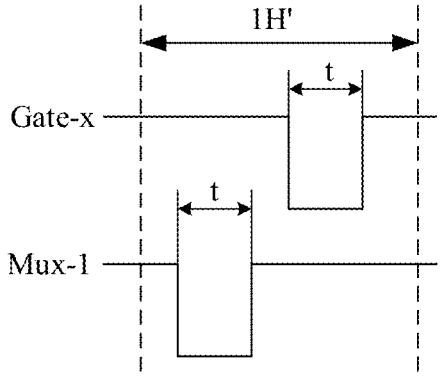
FIG. 13 schematically shows a time-division multiplexing signal timing sequence applicable to the driving method shown in FIG. 12.

Referring to FIG. 13, and in conjunction with reference to FIG. 2, FIG. 13 schematically shows the time-division multiplexing signal timing sequence used in the driving method shown in FIG. 12. In the time-division multiplexing signal timing sequence shown in FIG. 13, only the display area 110-1 is used for display, so only the data transmission control signal provided by the data transmission control signal line Mux-1 needs to be active, and subsequently the gate drive signal provided by one of the m display panel gate signal lines Gate-x becomes active. Thus, when the width of the active pulses of the data transmission control signal and the gate drive signal is kept constant (e.g., always the time period t shown in FIG. 2), the line scan time can be reduced from the line scan time 1H shown in FIG. 2 to the line scan time 1H' shown in FIG. 13. By reducing the line scan time, the refresh frequency can thus be increased in order to realize a high refresh frequency display.

Figure 14:
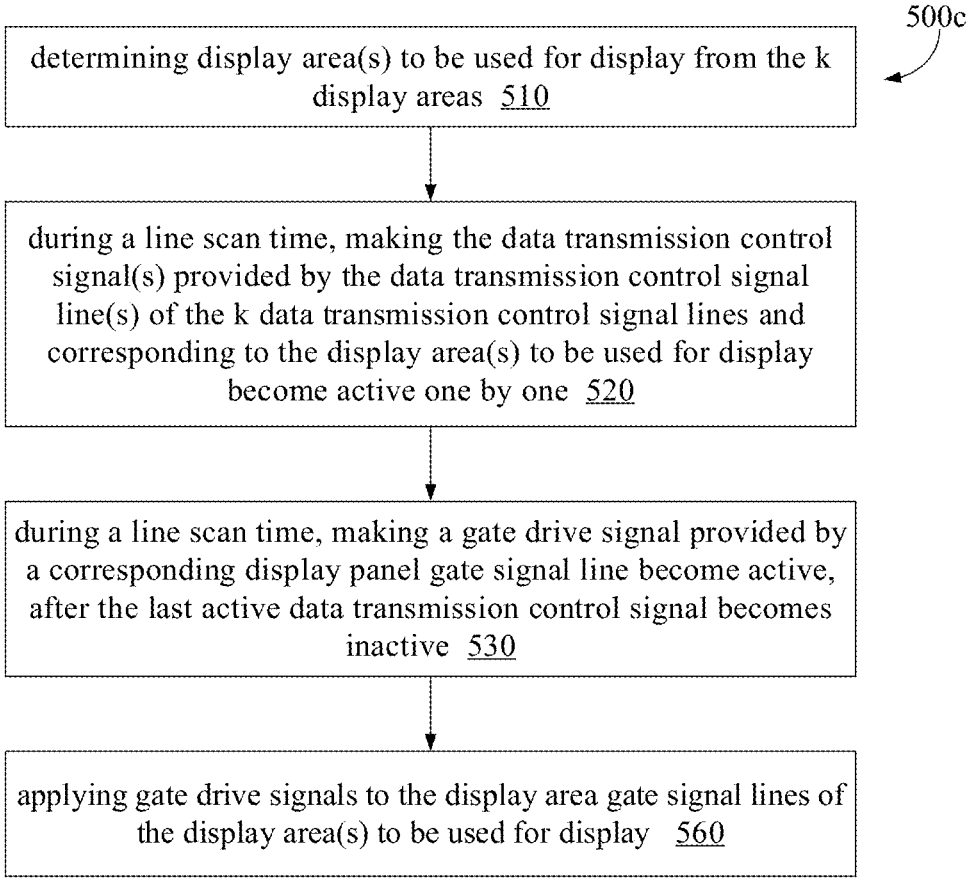
FIG. 14 schematically shows in the form of a flowchart, a driving method provided according to another exemplary embodiment of the present disclosure, which can be used to drive the foldable display panel shown in FIG. 3.

Referring to FIG. 14, it schematically shows, in the form of a flowchart, a driving method that is provided according to a further exemplary embodiment of the present disclosure and can be used to drive the foldable display panel 100*a* shown in FIG. 3. The driving method 500*c* shown in FIG. 14 is substantially the same as the driving method 500 shown in FIG. 9, differing only in that the driving method 500*c* further includes step 560: applying gate drive signals to the display area gate signal lines of the display area(s) to be used for display. As a result, the foldable display panel 100*a* is capable of further reducing power consumption when performing display.

It should be understood that the azimuth terms "up", "down", "front", "rear", "left", "right", "vertical", "horizontal", "top", "bottom", "inner" and "outside", etc. indicate orientations or positional relationships based on the orientations or positional relationships shown in the drawings. They are intended only to facilitate description of the present disclosure, and are not intended to indicate or imply that the device or element referred to must have a particular orientation or be constructed and operate in a particular orientation. Accordingly, these azimuth terms should not be construed as any limitations to the present disclosure.

As used in the present disclosure, singular forms "one," "a," and "the" are intended to include plural forms as well, unless the context clearly indicates otherwise. It is also understood that the terms "include" and "comprise", when used in the present disclosure, refer to the presence of the features described, but do not preclude the presence of one or more other features or the addition of one or more other features. In addition, the terms "first" and "second" are used for descriptive purposes only and are not to be construed as indicating or implying relative importance or the number of technical features indicated. These terms are used only to distinguish one feature from another. Thus, the features defined by the terms "first" and "second" may explicitly or implicitly include one or more of the features. In the description of the present disclosure, the phrase "plurality of" means two or more, unless otherwise expressly and specifically stated.

Unless otherwise stated, all terms used in the present disclosure, including technical and scientific terms, have the same meaning as commonly understood by one having ordinary skills in the art to which the present disclosure belongs. It should also be understood that terms such as those defined in commonly used dictionaries should be interpreted to have a meaning consistent with their meaning in the relevant fields and/or in the context of this specification, and should not be interpreted in an idealized or overly formal sense, unless expressly stated as such in the present disclosure.

In the description of the present disclosure, the terms "an embodiment", "some embodiments", "example", "specific example" or "some examples" means that the specific features, structures, materials, or characteristics described in connection with the embodiment or example are included in at least one embodiment or example of the present disclosure. In this specification, the schematic representation of the above terms need not be directed to the same embodiment or example. Moreover, the specific features, structures, materials or characteristics described may be combined in a suitable manner in any one or more embodiments or examples. In addition, without contradicting each other, a person skilled in the art may combine the different embodiments or examples described in this specification and may combine the features of the different embodiments or examples described in this specification.

It should be understood that the order of the steps in the method described in the present disclosure is merely exemplary and is not limiting. Thus, the steps of the method described in the present disclosure do not have to be performed in the order as described, but may be performed in a different order, or may also include any suitable additional steps, depending on practical needs. It should be understood that the logic and/or steps represented in the flowchart or otherwise described herein, for example, may be considered to be a sequenced list of executable instructions for implementing logical functions that may be specifically implemented in any computer-readable medium for use by, or in combination with, an instruction execution system, device, or apparatus (such as a computer-based system, a system that includes a processor, or other system that can take instructions from and execute instructions from an instruction execution system, device, or apparatus).

It should be understood that the various parts of the present disclosure may be implemented with hardware, software, firmware, or a combination thereof. In the above-mentioned embodiments, a plurality of steps or methods may be implemented with software or firmware stored in memory and executed by a suitable instruction execution system. For example, if implemented in hardware, they can be implemented with any of the following techniques or combinations thereof, which are well known in the art: discrete logic circuits with logic gates for implementing logic functions on data signals, specialized integrated circuits with suitable combinations of logic gates, programmable gate arrays, field programmable gate arrays (FPGAs), Field Programmable Gate Array (FPGA), etc.

The present disclosure is described in detail by means of the above-mentioned exemplary embodiments, but it should be understood that the above-mentioned exemplary embodiments are used only for purposes of illustration and explanation, and are not intended to limit the present disclosure to the scope of the described embodiments. It will be understood by those skilled in the art that more variations and modifications may be made in accordance with the teachings of the present disclosure, all of which fall within the scope of the protection claimed by the present disclosure. The scope of protection claimed by the present disclosure is defined by the appended claims.

What is claimed is:

1. A foldable display panel, comprising:

k display areas, wherein each display area comprises:

a pixel array arranged in a form of an m×n array;

j display area data signal lines, wherein each display area data signal line is configured to provide a data signal to at least one corresponding column of pixels in the pixel array;

i display panel gate signal lines, wherein each display panel gate signal line is configured to provide a gate drive signal to at least one corresponding row of pixels in the pixel array of each display area;

j display panel data signal lines, electrically connected with the j display area data signal lines, wherein each display panel data signal line is configured to provide a data signal to the foldable display panel;

s1 data transmission control signal lines, wherein each data transmission control signal line is configured to provide a data transmission control signal;

s2 data transmission control circuits, wherein each data transmission control circuit corresponds to at least one data transmission control signal line and at least one display area, and is configured to: in response to the data transmission control signal provided by the corresponding data transmission control signal line, bring the j display panel data signal lines into conduction with the display area data signal lines of at least one corresponding display area, respectively, wherein k is an integer greater than 1, m and n are integers greater than 0, respectively, i is an integer greater than 0 and less than or equal to m, j is an integer greater than 0 and less than or equal to n, and s1 and s2 are both integers greater than 1 and less than or equal to k, and s1 is greater than or equal to s2, wherein surrounding areas of each display area comprise a peripheral area surrounding each said display area, and wherein one of the k display areas is a master display area, and all data transmission control circuits are located in the peripheral area of the master display area.

2. The foldable display panel according to claim 1, wherein each of the i display panel gate signal lines is divided into k segments disconnected from each other, each segment forms a display area gate signal line of a corresponding display area, and the display area gate signal line is configured to provide a gate drive signal to at least one corresponding row of pixels in the pixel array of the corresponding display area.

3. The foldable display panel according to claim 1, wherein when the foldable display panel is folded, the master display area is used for display and the other display areas are not used for display.

4. The foldable display panel according to claim 3, wherein the foldable display panel comprises two display areas.

5. The foldable display panel according to claim 1, wherein the values of the integers s1 and s2 are both equal to the value of the integer k, such that the foldable display panel comprises k data transmission control signal lines and k data transmission control circuits, and wherein each data transmission control signal line corresponds to one data transmission control circuit and each data transmission control circuit corresponds to one display area.

6. The foldable display panel according to claim 5, wherein each data transmission control circuit comprises j transistors, the first electrode of each transistor is connected with one of the j display panel data signal lines and the second electrode thereof is connected with one of the j display area data signal lines of a corresponding display area, and the control electrodes of the j transistors are connected with a corresponding data transmission control signal line of the k data transmission control signal lines.

7. The foldable display panel according to claim 6, wherein the j transistors are all P-type transistors.

8. The foldable display panel according to claim 5, wherein the value of the integer i is equal to the value of the integer m and the value of the integer j is equal to the value of the integer n, such that the foldable display panel comprises m display panel gate signal lines and n display panel data signal lines, and each display area comprises n display area data signal lines, and wherein each display panel gate signal line is configured to provide a gate drive signal to a corresponding row of pixels in the pixel array of each display area, and each display area data signal line is configured to provide a data signal to a corresponding column of pixels in the pixel array.

9. The foldable display panel according to claim 8, wherein each of the m display panel gate signal lines is divided into k segments disconnected from each other, each segment forms a display area gate signal line of a corresponding display area, and the display area gate signal line is configured to provide a gate drive signal to a corresponding row of pixels in the pixel array of the corresponding display area.

10. A display device comprising:

the foldable display panel according to claim 1;

a timing controller configured to generate first control signals, second control signals and image data;

a gate driver configured to generate gate drive signals provided to the i display panel gate signal lines based on the first control signals;

a data driver configured to, based on the second control signals and the image data, generate data signals provided to the j display panel data signal lines, and generate data transmission control signals provided to the s1 data transmission control signal lines.

11. The display device according to claim 10, wherein the gate driver comprises a GOA circuit comprising i GOA units, each GOA unit corresponds to a display panel gate signal line and is configured to generate a gate drive signal provided to a corresponding display panel gate signal line.

12. The display device according to claim 10, wherein the value of the integer i is equal to the value of the integer m, the value of the integer j is equal to the value of the integer n, and the values of the integers s1 and s2 are both equal to the value of the integer k, such that the foldable display panel comprises m display panel gate signal lines and n display panel data signal lines, each display area comprises n display area data signal lines, the foldable display panel comprises k data transmission control signal lines and k data transmission control circuits, and wherein each display panel gate signal line is configured to provide a gate drive signal to a corresponding row of pixels in the pixel array of each display area, each display area data signal line is configured to provide a data signal to a corresponding column of pixels in the pixel array, and each data transmission control signal line corresponds to one data transmission control circuit, and each data transmission control circuit corresponds to one display area.

13. An electronic apparatus, comprising the display device according to claim 10.

14. A display device comprising:

the foldable display panel according to claim 2;

a timing controller configured to generate first control signals, second control signals and image data;

k gate drivers, each gate driver corresponding to a display area and configured to generate a gate drive signal provided to a display area gate signal line of the display area based on the first control signals;

a data driver configured to, based on the second control signals and the image data, generate data signals provided to the j display panel data signal lines, and generate data transmission control signals provided to the s1 data transmission control signal lines.

15. A driving method for driving the foldable display panel according to claim 7, comprising:

determining display area(s) to be used for display from the k display areas;

during a line scan time, making the data transmission control signal(s) provided by data transmission control signal line(s) of the k data transmission control signal lines and corresponding to the display area(s) to be used for display become active one by one; and during a line scan time, making a gate drive signal provided by a corresponding display panel gate signal line become active, after a last active data transmission control signal becomes inactive.

16. The driving method according to claim 15, further comprising:

increasing pulse width of the data transmission control signal(s) and the gate drive signal when the number of the display area(s) to be used for display is less than k.

17. The driving method according to claim 15, further comprising:

reducing the line scan time when the number of the display area(s) to be used for display is less than k.

18. The driving method according to claim 15, wherein each of the m display panel gate signal lines is divided into k segments disconnected from each other, each segment forms a display area gate signal line of a corresponding display area, and the display area gate signal line is configured to provide a gate drive signal to a corresponding row of pixels in the pixel array of the corresponding display area, the driving method further comprising:

applying gate drive signals to display area gate signal lines of the display area(s) to be used for display.

* * * * *